US010619311B2

(12) United States Patent
Becker et al.

(10) Patent No.: US 10,619,311 B2
(45) Date of Patent: Apr. 14, 2020

(54) BASE PLATE AND RAIL FASTENING POINT

(71) Applicant: Vossloh-Werke GmbH, Werdohl (DE)

(72) Inventors: Dietmar Becker, Iserlohn (DE); Michael Harraß, Wuppertal (DE); Michael Jonca, Ludenscheid (DE); Artur Wroblewski, Ludenscheid (DE); Adrian Bednarczyk, Ludenscheid (DE)

(73) Assignee: Vossloh-Werke GmbH, Werdohl (DE)

( * ) Notice: Subject to any disclaimer, the term of this patent is extended or adjusted under 35 U.S.C. 154(b) by 171 days.

(21) Appl. No.: 15/532,586

(22) PCT Filed: Dec. 2, 2014

(86) PCT No.: PCT/EP2014/076290
§ 371 (c)(1),
(2) Date: Jun. 2, 2017

(87) PCT Pub. No.: WO2016/086979
PCT Pub. Date: Jun. 9, 2016

(65) Prior Publication Data
US 2017/0321381 A1 Nov. 9, 2017

(51) Int. Cl.
*E01B 9/42* (2006.01)
*E01B 9/62* (2006.01)

(52) U.S. Cl.
CPC . *E01B 9/42* (2013.01); *E01B 9/62* (2013.01)

(58) Field of Classification Search
CPC ..... E01B 9/38; E01B 9/40; E01B 9/42; E01B 9/44; E01B 9/60; E01B 9/62; E01B 9/66
See application file for complete search history.

(56) References Cited

U.S. PATENT DOCUMENTS

| | | | | |
|---|---|---|---|---|
| 8,413,910 | B2 | 4/2013 | Bosterling et al. | |
| 2008/0179419 | A1* | 7/2008 | Vives Clavel | E01B 9/38 238/264 |
| 2011/0068183 | A1* | 3/2011 | Bednarczyk | E01B 9/40 238/264 |
| 2011/0068185 | A1* | 3/2011 | Bosterling | E01B 9/38 238/283 |
| 2013/0168460 | A1* | 7/2013 | Bosterling | E01B 9/685 238/287 |

(Continued)

FOREIGN PATENT DOCUMENTS

| | | | | |
|---|---|---|---|---|
| WO | 2011032970 | A2 | 3/2011 | |
| WO | WO-2011032970 | A2 * | 3/2011 | E01B 9/42 |

*Primary Examiner* — Jason C Smith
(74) *Attorney, Agent, or Firm* — The Webb Law Firm

(57) ABSTRACT

The present invention relates to a base plate for a rail fastening point, in which a rail for a rail vehicle is fastened on a substrate. The base plate includes a main body with a rib structure, which from the underside assigned to the substrate is formed into the main body of the base plate and is formed by ribs and by recesses which surround the ribs and are open to the underside, and to a rail fastening point. The base plate for a rail fastening point can be manufactured in a simple, cost-effective manner and makes it possible to avoid by simple means pressing into a soft substrate. This is achieved in that the base plate additionally includes a cover fastened to the base plate after the manufacture of the main body, which covers the rib structure on the underside of the main body at least in sections.

13 Claims, 3 Drawing Sheets

(56) References Cited

U.S. PATENT DOCUMENTS

| | | | | |
|---|---|---|---|---|
| 2013/0240635 | A1* | 9/2013 | Bosterling | E01B 9/303<br>238/349 |
| 2016/0017545 | A1* | 1/2016 | Bosterling | E01B 9/02<br>238/291 |
| 2016/0160450 | A1* | 6/2016 | Krieg | E01B 9/44<br>238/308 |
| 2016/0230352 | A1* | 8/2016 | Bednarczyk | E01B 9/22 |
| 2017/0321381 | A1* | 11/2017 | Becker | E01B 9/42 |

* cited by examiner

BASE PLATE AND RAIL FASTENING POINT

CROSS-REFERENCE TO RELATED APPLICATION

This application is the United States national phase of International Application No. PCT/EP2014/076290 filed Dec. 2, 2014, the disclosure of which is hereby incorporated in its entirety by reference.

BACKGROUND OF THE INVENTION

Field of the Invention

The invention relates to a base plate for a rail fastening point, where a rail for a rail vehicle is fastened on a substrate, wherein the base plate includes a main body with a rib structure, which from the underside assigned to the substrate is formed into the main body of the base plate and is formed by ribs and by recesses that surround the ribs and are open to the underside.

The invention also relates to a rail fastening point, at which a rail for a rail vehicle is fastened onto a substrate. Such rail fastening points typically form part of a track system on which rail vehicles travel. Such track systems each comprise at least two parallel extending rails, on which the respective rail vehicle rolls with its rail wheels. The fastening of the rails takes place with the aid of a plurality of identical rail fastening points of the type in question here, which are arranged at regular intervals along the track system and each comprise a base plate, which with its underside rests on the substrate and on which the rail to be fastened is supported, as well as at least one spring element and one tensioning element, by which the spring element is braced against the substrate. With this the spring element exerts an elastic hold-down force by which the rail is held on the base plate.

Description of Related Art

A base plate of the abovementioned type is known, for example, from US 2008/0179419 A1. Such base plates are used, in particular, in track systems, where the substrate carrying the rail is formed by comparatively flexible materials, such as, for example a wooden sleeper or an elastic layer with defined flexibility. By way of the base plate the static and dynamic forces that occur when a vehicle travels over the rail are distributed over a large area onto the comparatively soft substrate.

With this, as a result of the transverse forces that occur during the crossing of the rail and the accompanying tipping tendency of the rail in use, higher stresses occur in particular in the area of the base plate assigned to the so-called field side, i.e. the outer side facing away from the respective other rail of the track system to which the rail fixed in the respective fastening point belongs. Frequently, therefore, this area of the base plate is made wider or longer, so as to ensure also in the area of the greater stress an as uniform as possible distribution of the stresses on the substrate.

The base plate can be used simultaneously for fastening and guiding the rail. In these cases the base plate is generally shaped as a so-called "rib plate". Such a base plate comprises, on its top side that is free in use, a contact surface on which the rail is placed. To each side the contact surface is delimited by a rib. The ribs form lateral guides, on which the rail is guided with the longitudinal edges of its rail foot. The ribs absorb the transverse forces that occur during the crossing of the rail and lead them into the respective substrate. To this end the base plate may be fastened onto the substrate by means of suitable connections.

Another function of the base plate consists in practice in that the spring elements required for the elastic holding down of the rail on the respective substrate are held and guided on it. Used for this as a rule are ω- or S-shaped tension clamps, which by means of a tensioning element, for example a sleeper screw or a screw bolt, are clamped onto the substrate.

The rib structure formed into the underside of a base plate of the type mentioned here serves on the one hand to stiffen and on the other hand to minimise the weight of the base plate. Also, as a result of the clearly reduced material volume of the rib structure compared to a solid construction, it makes it possible to reliably manufacture the base plate of plastic.

In practice, however, it has proven problematical that when high stresses act on the rail the rib structure is pushed into the comparatively soft substrate and causes a permanent deformation there. This deformation can go so far that the position of the base plate no longer meets the specifications that permit a proper secure supporting of the rail.

In WO 2011/032970 A1 it was proposed, in order to eliminate these problems, to fill the recesses in the rib structure of the main body of the base plate with a filler. The filler enlarges the contact surface with which during use the base plate rests on the soft substrate, and has proven successful in practice. However, the manufacture of base plates where the rib structure is filled with a filler is comparatively complicated.

SUMMARY OF THE INVENTION

Against the background of the prior art explained in the foregoing, it is tan object of the invention to provide a base plate for a rail fastening point, which can be manufactured in a simple, low-cost manner, and with which by simple means pressing into a soft substrate is avoided.

In addition a rail fastening point is to be provided, with which it is ensured that the base plate permanently retains its position also when the base plate is positioned on a comparatively soft substrate and in practice is subjected to high local stresses.

Advantageous embodiments of the invention are indicated in the dependent claims and, the same as the general idea of the invention, will be explained in detail in the following.

In agreement with the base plates for a rail fastening point mentioned at the outset and known from the prior art, where a rail for a rail vehicle is fastened on a substrate, the base plate according to the invention also comprises a main body with a rib structure, which from its underside assigned to the substrate is formed into the base plate and is formed by ribs and by recesses surrounding the ribs which are open to the underside.

According to the invention, the base plate now additionally comprises a cover, which after manufacture of the main body is fastened to the main body, wherein the cover covers the rib structure on the underside of the main body of the base plate at least in sections.

Also the invention therefore proceeds from the understanding that, in order to avoid damage to the substrate by the rib structure formed into the base plate, it is necessary that the stress exerted on the base plate during use is distributed over a large area onto the substrate. To this end the invention provides a cover, which after the shaping of the rib plate is placed on the rib structure on its underside assigned to the substrate, and then during use is arranged between the base plate and the substrate on which the base plate rests.

With the invention, a simple possibility is thereby found for evenly and over a large area distributing onto the substrate the high stresses that occur during the crossing of a rail fastening point formed using a base plate according to the invention. Load peaks as occur with the conventional base plates provided with an open rib structure in the area of the line-shaped contact, which exists there during use between the web-like ribs of the rib structure and the substrate, are thereby safely avoided by using a base plate according to the invention.

At the same time the subsequent fastening of the cover to the main body of the base plate, makes it possible to optimise the shaping in particular of the rib structure of the main body of the base plate independently of the cover with regard to saving weight, the manufacture and rigidity of the base plate. Also the expense for fastening the cover to the base plate is minimal, since in order to complete the base plate, only the main body and the cover need to be joined together.

With the invention, therefore, a base plate that can be produced cost-effectively is made available, with which the danger of damage to the substrate or an insecure supporting of the respective rail during use is reduced to a minimum. Thus it is possible with the base plate according to the invention, with a weight of the base plate reduced to a minimum, to permanently and securely support a rail also on elastic intermediate layers, wooden sleepers or other comparatively flexible substrates, without this requiring a special effort.

The installation of a base plate according to the invention is particularly simple due to the fact that the main body of the base plate and the cover fastened to it form a structural unit, which on the construction site can be handled as a unit and can, therefore, be installed without problems at the intended site. Unlike with rail fastening systems where the base plate stands on a specially provided intermediate plate, a base plate according to the invention is, therefore, superior to conventional base plates, not only with regard to its practical value, but also with regard to the simplicity of its manufacture and its ease of assembly.

The cover can be fixed to the main body of a base plate according to the invention detachably or undetachably. In this connection it is not absolutely essential that the position on the main body is unalterable. On the contrary, it may be expedient to fasten the cover to the main body loose or with play such that, after placing the base plate on the respective substrate, a relative movement between cover and main body is still possible. In this way the main body, after placing it on the substrate, can be moved to a certain extent independently of the cover, so as to find its optimal position of use. When, on the other hand, it must be ensured that the relative position of cover and main body must always be retained, it may be expedient to fix the cover firmly to the main body of the base plate.

The fastening of the cover to the main body of the base plate can take place cohesively, e.g. by bonding or welding, by force-locking or form-locking, wherein these fastening types can, of course, also be realised in combination with one another. For the form-locking or force-locking connection additional means may be provided, by means of which the cover is, for example, clipped, screwed or locked to the base plate. In the event that a form- or force-locking connection must be produced, it may alternatively or additionally be expedient to form onto the underside of the main body of the base plate at least one holding element for the form- or force-locking securing of the cover.

Naturally, depending on the type of loading to which the base plate is exposed during use, it may be advantageous to cover the entire underside of the main body resting on the substrate with the cover over its complete surface.

In many applications it will suffice, however, to provide the cover only in the area of the base plate where during use particularly high stresses are concentrated. Accordingly, a special practical embodiment of the invention provides that the cover covers a section of the underside of the main body of the base plate, which during use is exposed to a higher pressure load than an adjacent section not covered by the cover. With the rail fastening points installed in practice it is, therefore, expedient to arrange the cover typically in the area of the base plate facing the field side.

To permit on the one hand a simple fastening of the cover to the base plate and, on the other hand, to ensure a secure large-area supporting of the base plate, a depression corresponding to the shape of the cover may be formed in the area of the underside of the base plate where the cover is arranged, the depth of said depression being equal to the thickness of the cover. The cover placed in the depression is then with its free side assigned to the substrate aligned flush with the surrounding material on the underside of the base plate such that a uniform large-area supporting of the base plate on its underside is ensured.

The advantages of the invention are evident in particular with base plates that are made from a plastic material. Such base plates are, in principle, known in practice in large numbers and are typically made of a suitable thermoplastic material, such as a polyamide material or other plastics of adequate strength. To increase the strength, the plastic may, in a similarly known manner, be fibre-reinforced. The rib structure formed into the underside of the base plate, consisting of ribs and recesses, permits a plastic-compatible design here, with which the accumulation of large material volumes is avoided and at the same time a very precise, economical and simultaneously material-saving forming of the base plate by conventional manufacturing processes is made possible. The rib structure in the case of a plastic base plate of the type according to the invention also proves particularly advantageous for an economical manufacture since the wall thickness goes square into the cooling time.

The cover can also consist of any other suitable material, which at a low thickness ensures sufficient rigidity and wear resistance taking into account the friction pairing which results when the base plate according to the invention with the cover is placed on the respective substrate. Covers made of a metal material or plastic may for example be expedient. The manufacture of the cover from plastic can have the advantage here of a low-cost manufacture and further processing, as well as high resistance also in an environment where high moisture and other environmental conditions that are corrosive to metal prevail.

Irrespective of how the manufacture takes place, it is decisive for the invention that the rib structure of the main body on its underside also extends in the area on which the cover is placed after the shaping of the main body.

This can be ensured in a simple manner by manufacturing the main body and cover separately from one another. Such a separate manufacture of cover and main body can provide not only production advantages during the manufacture of the main body and cover of the base plate from the same plastic, but also makes it possible to manufacture the main body and cover from different materials that are optimally adapted to their respective purpose.

If the cover and main body of the base plate are, for example, made of plastic, it is, however, also possible to shape the main body and the cover in one operation, wherein the positioning of the cover on the underside of the main body is carried out subsequently by a deforming of the cover or main body. To this end, for example, the cover and the main body can be produced in one tool next to one another, but joined together in such a way that between the main body and the cover a hinge-like connection is produced, which defines a swivel axis so that the cover can be swiveled onto the underside of the main body. It is also conceivable during the joint manufacture of the cover and main body, to provide a predetermined breaking point between cover and main body, along which the cover can be separated from the main body to subsequently position it onto the underside of the main body.

Below the invention will be explained in more detail with reference to a drawing which illustrates an exemplary embodiment.

DESCRIPTION OF THE INVENTION

Figure 1:
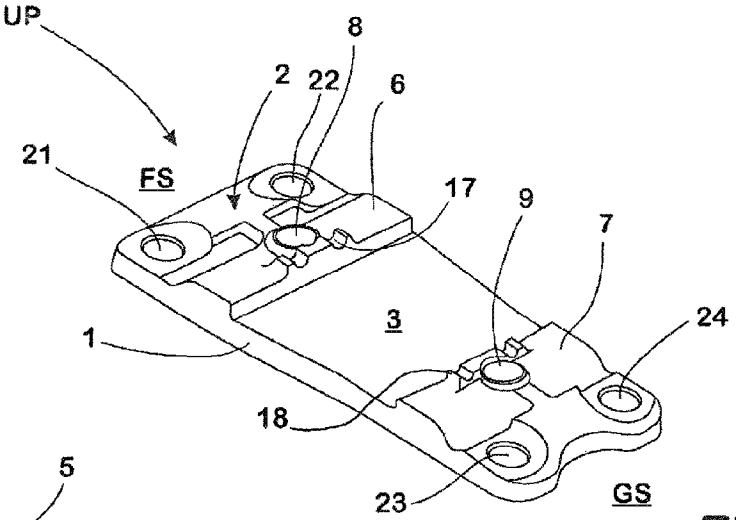
FIG. 1 is a base plate in a perspective view from above.
Figure 2:
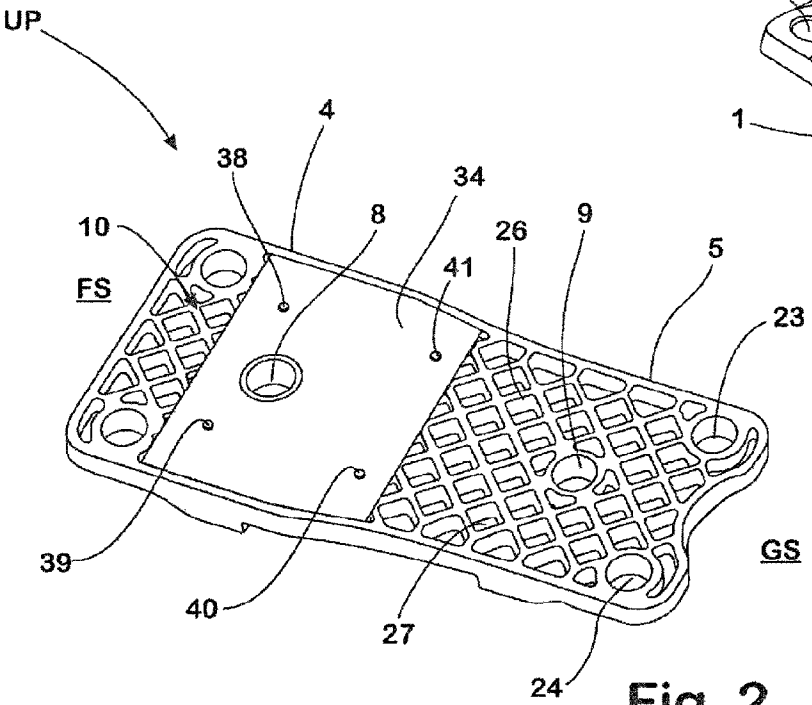
FIG. 2 is the base plate according to FIG. 1 in a perspective view from below.
Figure 4:
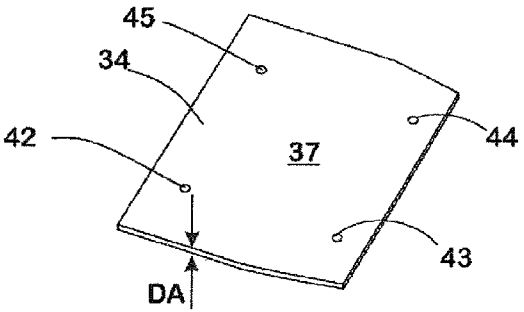
FIG. 4 is a cover for the base plate in a perspective view from below.
Figure 3:
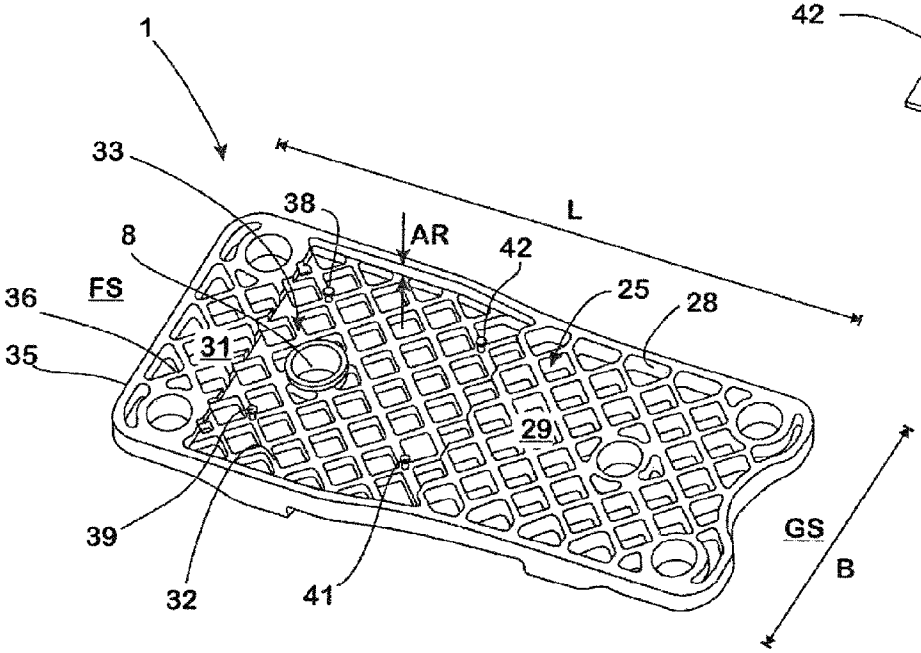
FIG. 3 is the main body of the base plate in a perspective view from below.
Figure 5:
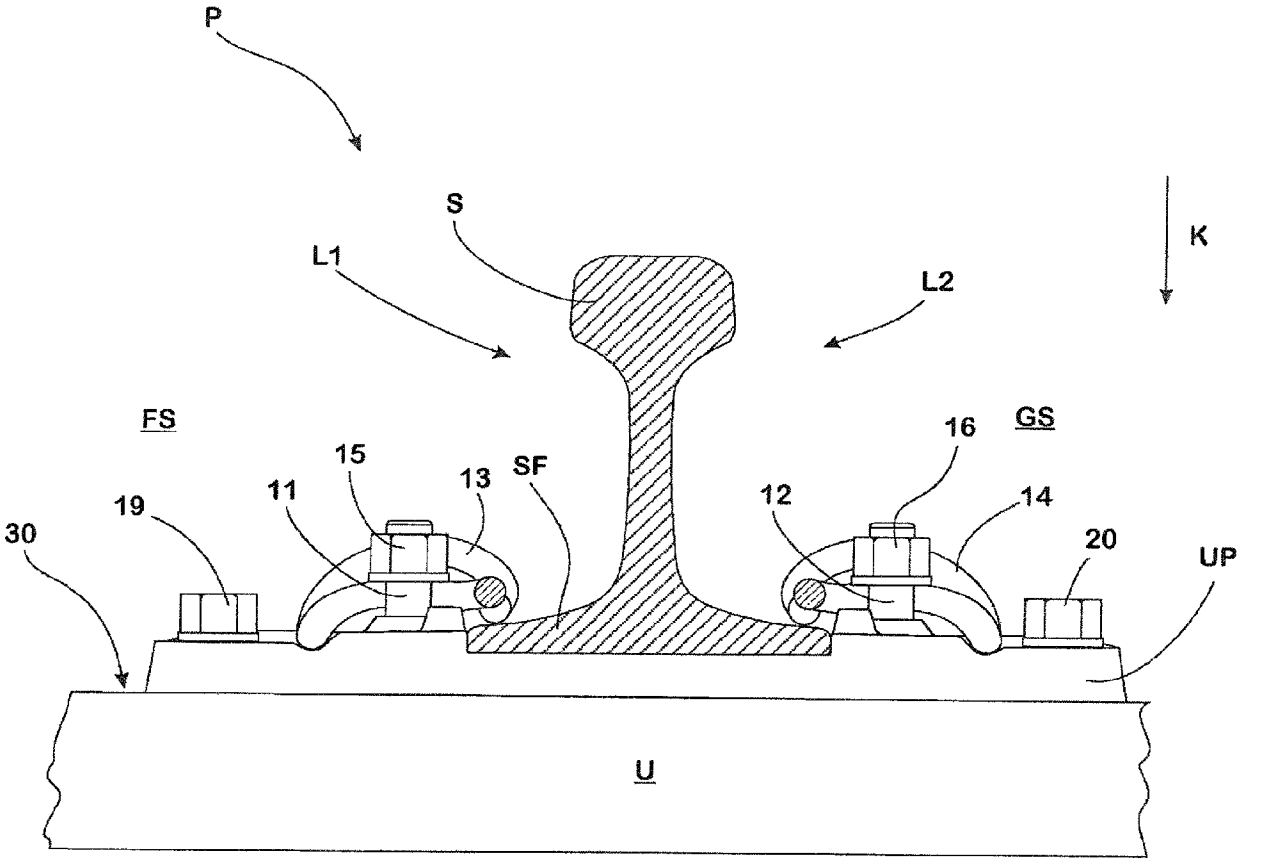
FIG. 5 is a rail fastening point formed with the base plate in a side view.

The base plate UP used in a rail fastening point P for fastening a rail S on a substrate U formed by a wooden sleeper comprises a main body 1, which is made of a fibre-reinforced polyamide plastic and is shaped as a rib plate. The base plate UP, seen from the top, has a rectangular basic shape with a width B measured in the longitudinal direction of the rail S to be fastened and a length L aligned transverse thereto.

On its top side 2 the main body 1 has a contact surface 3, which extends over the width B of the base plate UP. During use the rail S is located with its rail foot SF on the contact surface 3. Between the rail foot SF and the contact surface 3 there may be, in a manner known per se, further plate elements of elastic or rigid material not illustrated here to give the support of the rail S on the base plate UP a certain flexibility in the direction of gravity K or to evenly distribute the stresses that occur when the rail S is being crossed.

The rail S and the rail fastening point P form part of a track system not further illustrated here, with which parallel to the rail S a further similar rail is arranged at a defined distance and fastened in rail fastening points, which are each shaped like the rail fastening point P. Accordingly, with the rail S a distinction can be made between a longitudinal side L1, which is assigned to the field side FS facing away from the other rail of the track system, and a longitudinal side L2 which is assigned to the track side GS assigned to the other rail.

Since during use, when a rail vehicle travels over the rail S, greater stresses occur, the section 4 of the base plate UP assigned to the field side FS is longer and wider compared to the section 5 of the base plate UP assigned to the track side GS.

The contact surface 3 at its transitions to the sections 4, 5 is in each case limited by a guide rib 6, 7, which also extends over the width B of the base plate UP. In the guide ribs 6, 7, in each case aligned centrally in relation to the width B, a through-opening 8, 9 is formed, which leads from the top side 2 to the opposite underside 10 of the base plate UP and its main body 1, assigned to the substrate U.

The threaded shaft of a tensioning element 11, 12, normally a tensioning screw used for this purpose is respectively guided through, in a manner known per se, the through-openings 8, 9 during use said tensioning element sits with its head in a depression formed into the underside 10 and is supported in the longitudinal direction of the tensioning element 11, 12 against a shoulder of the main body 1 of the base plate UP formed there.

The section of the threaded shaft of the tensioning element 11, 12 that sticks out freely above the top side 2 engages through the centre loop of a ω-shaped spring element 13, 14, in the technical language also called a "tension clamp", which is conventionally shaped and with the free ends of its holding arms exerts an elastic hold-down force on the rail foot SF, by which the rail S is kept pressed against the substrate U. To this end the spring elements 13, 14 are clamped against the main body 1 of the base plate UP by means of a nut 15, 16 screwed onto the respective threaded section of the tensioning elements 11, 12 and acting against the centre loop of the respective spring element 13, 14.

On the top side 2 of the main body 1 of the base plate UP shaped elements 17, 18 are formed in a manner known per se, which guide the spring elements 13, 14 and thus secure them in their position on the base plate UP.

The fastening of the base plate UP on the substrate U takes place by means of sleeper screws 19, 20 which are screwed into the substrate U through through-openings 21, 22, 23, 24 formed in the four corner areas of the main body 1.

A rib structure 25 consisting of diagonally aligned, intersecting ribs 26 and recesses 27 delimited by the ribs 26, is formed into the underside 10 of the main body 1 of the base plate UP. The rib structure 25 is bordered by a side wall 28 surrounding the base plate 1, the narrow side of which assigned to the underside 10 spans a contact surface 29, by means of which the base plate UP rests on the top side 30 of the substrate U during use.

In an area 31 of the underside 10 assigned to the field side FS, the ribs 26 of the rib structure 25 end with their narrow sides 32 assigned to the underside 10 at a distance AR from the contact surface 29, whereas the narrow sides 32 of the ribs assigned to the underside 10 lie outside this area 31 in the contact surface 29. In this way, a depression 33 is formed in the area 31 in the main body 1, said depression is intended to hold a cover 34 and the depth of which corresponds to the distance AR.

The area 31 extends here in the direction of the width B between the surrounding side wall 28 and in the direction of the length L proceeding from about the middle of the base plate UP in the direction of the narrow side 35 of the base plate UP assigned to the field side FS. It ends at the edge area 36 of the underside 10 adjoining the narrow side 35, into which the through-openings 21, 22 provided there are formed. In this way sufficient material is available in the edge area 36 for a dimensionally stable, secure and accurately-positioned fixing of the base plate UP on the substrate U under the effect of the sleeper screws 19, 20.

The peripheral shape of the cover 34, made as a flat, plate-like component, also for example of polyamide plastic, is adapted to the peripheral shape of the depression 33 provided in the main body 1. At the same time the thickness DA of the cover 34 corresponds to the distance AR by which the ribs 26 end in the area of the depression 33 underneath the contact surface 29. When the cover 34 is placed into the depression 33, the contact surface 37 of the cover 34 assigned to the substrate U is, therefore, aligned flush with the contact surface 29.

For an accurately-positioned fixing of the cover 34 in the depression 33 during the storage, the transport and the installation, four mushroom-shaped projections 38, 39, 40, 41 are formed integrally onto the main body 1 in the corner areas of the depression 33, which are pushed through correspondingly arranged through-openings 42, 43, 44, 45 of the cover 34. The diameter of the through-openings 42-45 is slightly smaller than the maximum diameter of the projections 38-41 such that when the projections 38-41 are pushed through, a slight elastic resistance must be overcome and the cover 34, after the projections 38-41 have penetrated the openings 42-45 with their thickest part, is held in a form-fitting manner on the main body 1.

During the installation of the base plate UP on the substrate U it may happen that the projections 38-41 break off or penetrate into the substrate U. However, this does not matter since at this point the cover 34 sits securely in the depression 33 and rests against the substrate U. The high pressure loads which occur when the rail fastening point P is crossed, concentrated in the area 28, are distributed evenly and over a large area via the cover 34 onto the substrate U such that pressing of the rib structure 25 into the substrate U is securely avoided here.

REFERENCE NUMERALS

1 Main body of the base plate UP
2 Top side of the main body 1
3 Contact surface
4 section of the base plate UP assigned to the field side FS
5 section of the base plate UP assigned to the track side GS
6, 7 Guide ribs
8, 9 Through-openings
10 Underside of the base plate UP and of the main body 1
11, 12 Tensioning elements (tension screws)
13, 14 Spring elements (tension clamps)
15, 16 Nuts
17, 18 Shaped elements
19, 20 Sleeper screws
21-24 Through-openings in the four corner areas of the main body 1
25 Rib structure
26 Ribs
27 Recesses
28 Surrounding side wall of the main body 1
29 Contact surface of the main body 1 and of the base plate UP
30 Top side of the substrate U
31 Area of the underside 10 assigned to the field side FS
32 Narrow side of the ribs 26
33 Depression
34 Cover
35 Narrow side of the base plate UP assigned to the field side FS
36 Edge area of the underside 10
37 Contact surface of the cover 34
38-41 Mushroom-shaped projections (holding elements for the cover 34)
42-45 Through-openings of the cover 34
AR Distance
B Width of the base plate UP
DA Thickness of the cover 34
FS Field side
GS Track side
K Direction of gravity
L Length of the base plate UP
L1, L2 Longitudinal sides of the rail S
P Rail fastening point
S Rail
SF Rail foot
U Substrate (wooden sleeper)
UP Base plate

The invention claimed is:

1. A base plate for a rail fastening point, in which a rail for a rail vehicle is fastened on a substrate, the base plate comprising:

a main body with a rib structure, which from the underside assigned to the substrate is formed into the main body of the base plate and is formed by ribs and by recesses which surround the ribs and are open to the underside; and a cover, which after manufacture of the main body is fastened to the base plate and which covers the rib structure on the underside of the main body at least in sections, wherein the cover covers an area of the underside of the main body of the base plate, which during use is exposed to a higher pressure loading than an adjacent section not covered by the cover.

2. The base plate according to claim 1, wherein the cover is firmly fixed to the base plate.

3. The base plate according to claim 1, wherein the cover is fastened to the base plate in a force- or form-locking manner.

4. The base plate according to claim 3, wherein at least one holding element is formed on the underside of the main body for the form- or force-locking holding of the cover.

5. The base plate according to claim 1, wherein the base plate is formed as a rib plate, the rib plate comprising a top side having a contact surface for the rail to be fastened, wherein opposing narrow sides of the contact surface are respectively delimited by a guide rib.

6. The base plate according to claim 1, further comprising a depression corresponding to the shape of the cover formed in the area of the underside of the main body in which the cover is arranged, the depth of said depression being equal to the thickness of the cover.

7. The base plate according to claim 1, wherein the base plate is made of a plastic material.

8. The base plate according to claim 1, wherein the cover is made of a plastic material.

9. The base plate according to claim 1, wherein the cover is made of a metal material.

10. The base plate according to claim 1, wherein the cover and the main body are manufactured in one operation.

11. The base plate according to claim 1, wherein the cover and the main body are manufactured separately from one another.

12. A rail fastening point, in which a rail for a rail vehicle is fastened on a substrate, comprising:

a base plate formed according to claim 1, which rests with the underside of the main body on the substrate and on which the rail is supported;

at least one spring element;

and a tensioning element, by which the spring element is braced against the substrate, wherein the spring element exerts an elastic hold-down force by which the rail is held on the base plate.

13. The rail fastening point according to claim 12, wherein the substrate is formed by a wooden sleeper.

* * * * *